US005435598A

United States Patent [19]

Robinson

[11] Patent Number: 5,435,598

[45] Date of Patent: Jul. 25, 1995

[54] PORTFOLIO AND BLANK FOR PRODUCING THE SAME

[76] Inventor: Robert T. Robinson, 8400 Camellia Dr., Raleigh, N.C. 27613

[21] Appl. No.: 203,635

[22] Filed: Feb. 28, 1994

[51] Int. Cl.[6] ..... B42D 3/00

[52] U.S. Cl. ..... 281/45; 281/21.1; 281/29; 402/73; 402/74

[58] Field of Search ..... 281/21.1, 29, 45; 402/73, 74

[56] References Cited

U.S. PATENT DOCUMENTS

| | | | |
|---|---|---|---|
| 860,034 | 7/1907 | Kerby | 402/74 |
| 1,016,789 | 2/1912 | Smith | 281/45 |
| 4,548,426 | 10/1985 | Lockhart . | |
| 4,706,994 | 11/1987 | Lockhart . | |
| 4,971,361 | 11/1990 | Whiting | 281/2 |

FOREIGN PATENT DOCUMENTS

| | | | |
|---|---|---|---|
| 2286006 | 5/1976 | France | 281/29 |
| 227144 | 10/1910 | Germany | 281/29 |

*Primary Examiner*—Mark Rosenbaum
*Assistant Examiner*—David P. Bryant
*Attorney, Agent, or Firm*—Richard S. Faust

[57] ABSTRACT

A portfolio is formed from a blank of relatively rigid sheet material that includes front and rear covers hingedly connected for enclosing a multiple-page document. A document securement flap extends as an integrally formed member from the top edge of the rear cover. The document securement flap includes multiple panels defined by parallel fold lines. Folding of the panels about the fold lines creates a pocket for receiving and securing the upper marginal edge of the multiple-page document, and creates a structure that permits the document so secured to pivot about the fold line at which the document securement flap joins the rear cover.

19 Claims, 3 Drawing Sheets

PORTFOLIO AND BLANK FOR PRODUCING THE SAME

FIELD OF THE INVENTION

The invention relates to binders and related structures for holding together multiple-page documents such as business reports, tax returns, and the like.

BACKGROUND OF THE INVENTION

Numerous time-honored methods exist for securing together documents such as business reports and tax returns. These methods include ring binders, spiral binders, and other types of portfolios and notebooks. The above binding systems have their own sets of advantages and disadvantages. Most notably, these systems generally require assembly of multiple components, either by the manufacturer or end-user.

There is a need for a simple, inexpensive, one-piece structure that can be readily folded into a configuration to receive and secure a document, while presenting the highly attractive and professional appearance demanded by tax accountants and other professionals.

SUMMARY OF THE INVENTION

The present invention provides a document securement system that can be formed solely from a single, flat blank of sheet material. A multiple-page document can be protected thereby, and simple securement and fastening means such as staples and transfer tape are used to secure the document therein.

In one aspect, the invention may be defined as a document securement system which includes a blank of sheet material, with the blank including a front cover portion, a rear cover portion and a central hinge portion permitting relative movement of the front cover portion over the back cover portion to cover the document. The blank further includes a document securement flap extending from an edge of one of the cover portions. The flap serves to define a first fold line at the mentioned edge and sequential second, third and fourth fold lines substantially parallel to the first fold line. The four fold lines, in turn, define respective first, second, third and fourth panels sequentially extending from the cover portion. The third and fourth panels are each folded approximately 90° about the third and fourth fold lines to form a pocket for receiving one marginal edge portion of the multiple-page document. Document securement means, preferably in the form of staples, secures the document in the pocket. Thereafter, the first and second panels are folded about the second fold line to bring the back surfaces thereof into contact where they are fastened together by fastening means, preferably activated transfer tape.

The blank may include a fifth panel that is folded back upon the fourth panel and fastened thereto to hide the staples from view.

The five panels are joined to each other and to the cover portion from which the document securement flap extends by a series of parallel fold lines. The fold lines are preferentially chosen as cut scores or perforation lines to optimize the assembly process and the integrity of the completed product.

In a particular preferred embodiment, the document securement flap extends from the top edge of the rear cover to provide a finished portfolio system wherein the multiple-page document is secured and pivotable at the top of the rear cover.

In another aspect, the invention may be defined as a blank of relatively rigid sheet material useful, in association with appropriate securement or fastening means, to form a portfolio of the above-mentioned type.

BRIEF DESCRIPTION OF THE DRAWINGS

Some of the objects having been stated, other objects will appear as the description proceeds, when taken in connection with the accompanying drawings, in which.

DETAILED DESCRIPTION OF THE INVENTION

While the present invention will be described more fully hereinafter with reference to the accompanying drawings, in which aspects of the preferred manner of practicing the present invention are shown, it is to be understood at the outset of the description which follows that persons of skill in the appropriate arts may modify the invention herein described while still achieving the favorable results of this invention. Accordingly, the description which follows is to be understood as being a broad, teaching disclosure directed to persons of skill in the appropriate arts, and not as limiting upon the present invention.

Figure 1:
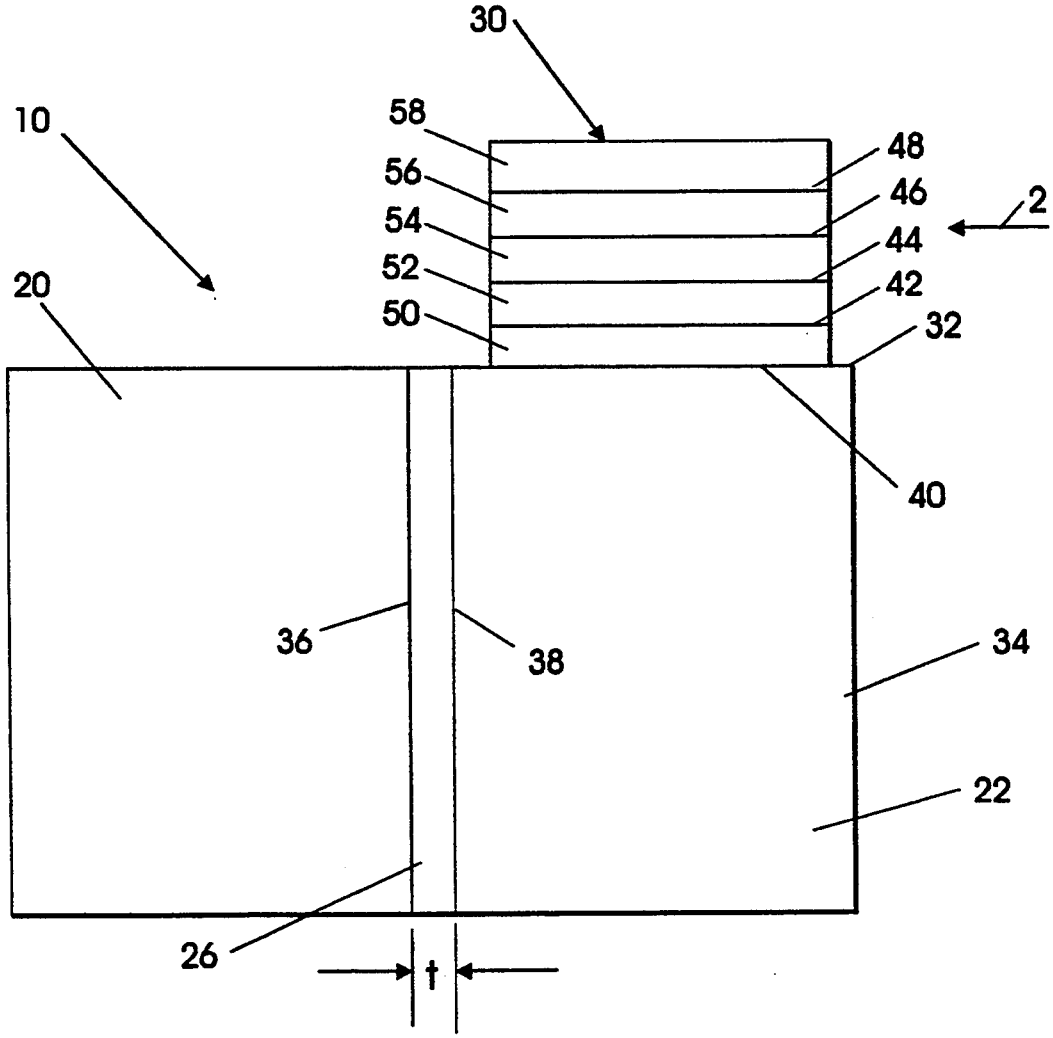
FIG. 1 is a plan view of the front of the blank used to form the portfolio of the present invention. The blank is shown in a flat state after being cut from stock paper and prior to any of the assembly steps utilized to secure a business report or tax return therein.
Figure 2:
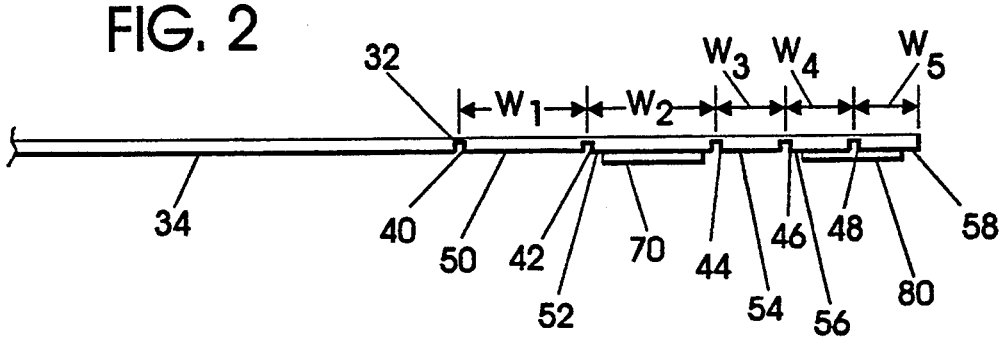
FIG. 2 is an enlarged side view of a portion of the blank taken in the direction of the arrow 2 of FIG. 1 showing the various fold lines formed by perforations and cut scores in the document securement flap, as well as the two transfer tapes used as panel fastening means.
Figure 6:
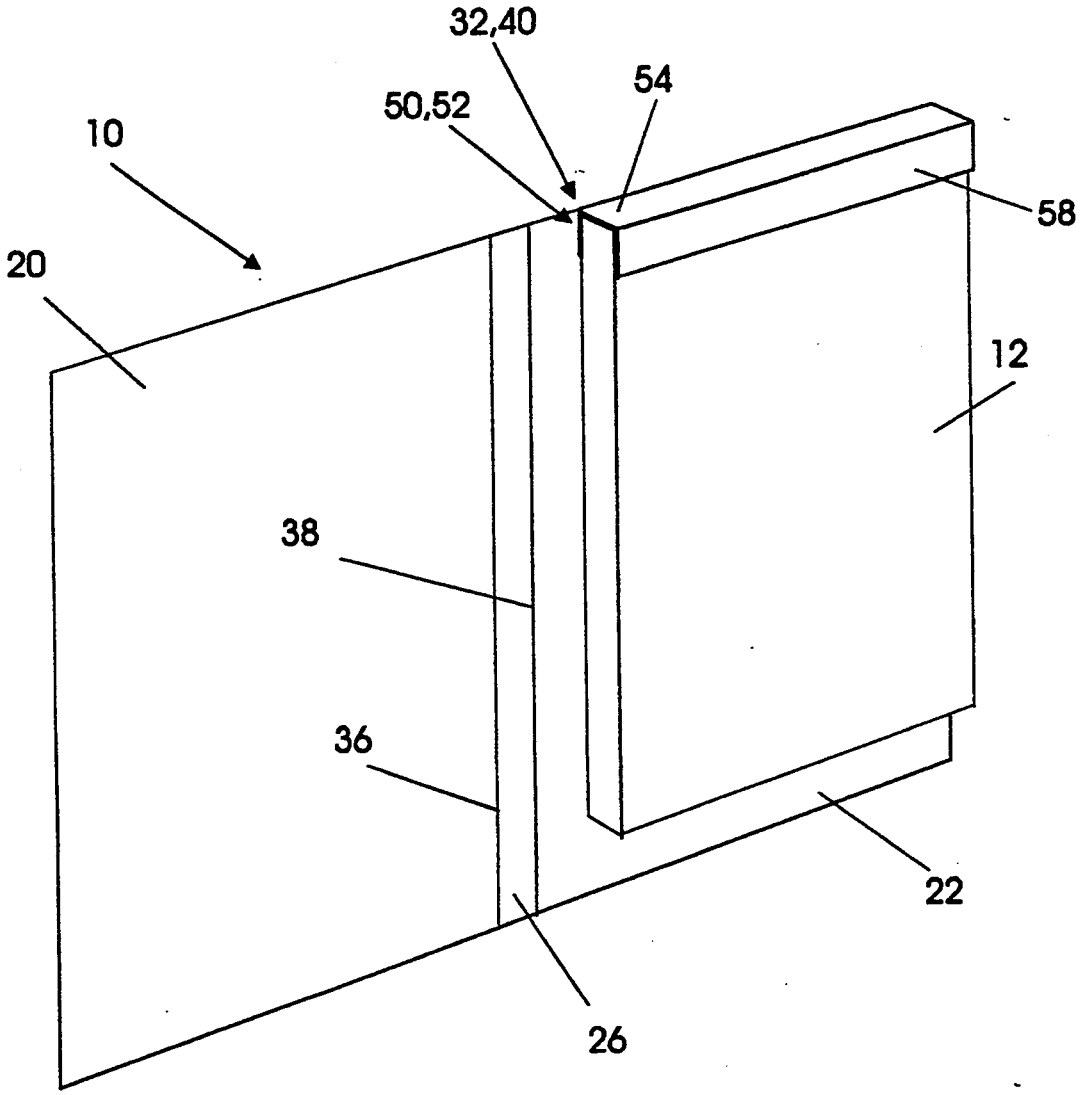
FIG. 6 is a pictorial view of the completed portfolio.

Referring to the drawings, and particularly to FIG. 1, there is shown the front side of a blank 10 of relatively rigid sheet material that is used to form a portfolio for securement and protection of a multiple-page document 12 such as a business report, tax return, or the like. The complete portfolio (FIG. 6) is produced using only blank 10, the multiple-page document, document securement means (e.g. staples) and panel fastening means (e.g. activated transfer tape, glue). The structure of blank 10 and its use in forming the portfolio will be described below.

Blank 10 includes a front cover portion 20, a rear cover portion 22, a hinge 26 connecting the front and rear cover portions, and an integrally formed document securement flap 30 that extends from top edge 32 of rear cover portion 22. The perimeter configuration of blank 10 may be produced by die cutting the same from relatively rigid sheet material by means well known in the art.

Front and rear cover portions 20, 22 are generally rectangular and sized to accommodate any size of paper that may be used for the document. As an example, cover portions 20, 22 may be approximately 9"×11½" to accommodate an 8½×11" document.

Hinge 26 may take any suitable form. In the illustrated embodiment, hinge 26 is formed by a pair of parallel fold lines 36, 38 that are separated by a distance "t" that roughly corresponds to the maximum thickness of a report that can be accommodated within the portfolio.

The purpose of front and rear cover portions 20, 22 and hinge 26 is to fully cover the enclosed report on both sides and along one edge when the cover is closed. The purpose of document securement flap 30, as described in more detail below, is to provide means for securing the document to one of the cover portions, in this case to rear cover portion 22, in a simple and reliable fashion, so that the document may be readily accessed by a user.

In a preferred embodiment, document securement flap 30 is formed as a rectangular panel that extends from one of the edges of the cover portions, in this case top edge 32 of rear cover portion 22. Flap 30 serves to define a first fold line 40 that lies along edge 32 and sequential second, third, fourth, and fifth fold lines 42, 44, 46, 48, respectively, that are parallel to edge 32 and define respective first, second, third, fourth and fifth flap panels 50, 52, 54, 56, 58 sequentially extending from cover portion 22.

Referring to FIGS. 2–6, the method of securing and covering a document utilizing blank 10 will now be described in detail. To facilitate the securement of the document the five panels are provided with preferred relative dimensions as described below, and the five fold lines are formed in such a way as to facilitate the securement of the document for a structurally sound and aesthetically pleasing end-result. To this end, first and second panels 50, 52 preferably have the same width $W_1$, $W_2$. The fourth and fifth panels, likewise, have substantially equal width dimensions $W_4$, $W_5$. The third panel has a width dimension $W_3$ which is selected as the dimension representing the maximum thickness of a multiple page document to be secured into the portfolio. In a preferred manner of practicing the invention, dimension $W_3$ is selected to roughly correspond to the dimension "t" defined by the two hinge fold lines 36, 38, with the dimension "t" being somewhat larger than the dimension $W_3$.

Figure 3:
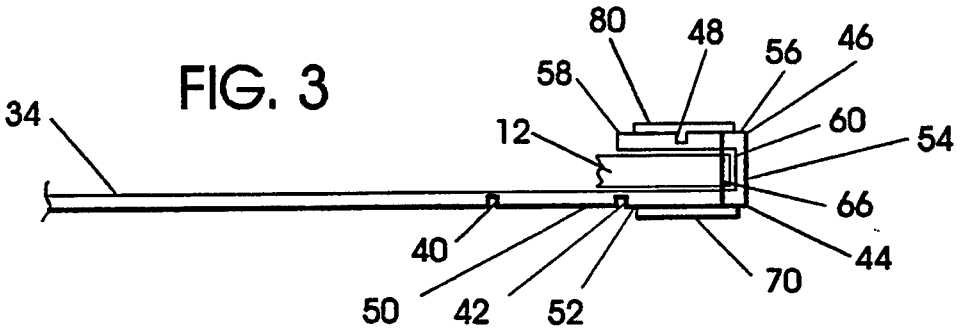
FIG. 3 is a view similar to FIG. 2 showing the document securement flap folded along two of the fold lines to create a pocket, a document in the pocket and staples affixing the document therein.

As illustrated in FIG. 3, the folding of document securement flap 30 about fold lines 44, 46 produces a pocket 60 into which one edge of the multiple-page document 12 is inserted. Following the formation of pocket 60 and the insertion of the document therein, suitable securement means, for example staples 66, are utilized to secure the document in the pocket. The staples extend through panel 56, the pages of the document and panel 52.

Figure 4:
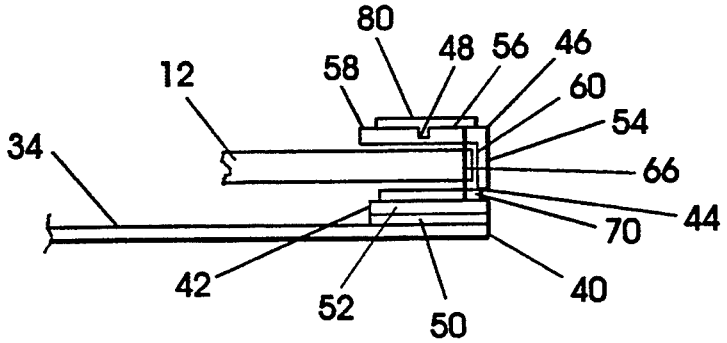
FIG. 4 is a view similar to FIG. 3 showing securement of the backs of the first and second panels to each other utilizing activated transfer tape as the fastening means.

Following securement of the document within pocket 60, the first and second panels are folded into the orientation shown in FIG. 4 around fold lines 40, 42, prior to which transfer tape 70 is activated to serve as a fastening means for fastening the back surfaces of panels 50, 52 together.

Figure 5:
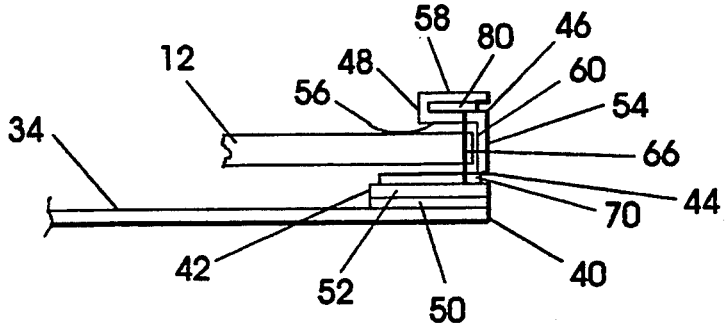
FIG. 5 illustrates the securement of the fourth and fifth panels to each other to cover the staples, using activated transfer tape as the fastening means.

Referring to FIG. 5, as a final step, transfer tape 80 is activated to serve as a fastening means along the rear surfaces of panels 56, 58 so that panel 58 may be folded back 180° into contact with panel 56 and secured thereto in order to hide the staples from view. In the structure so described, it will be appreciated that the report is now fully secured and is pivotable with respect to back cover portion 22 along fold line 40.

It will be appreciated that the document securement flap 30 may be formed with only four panels in those instances when it is not deemed necessary or desirable to cover the staples. However, it has been found that the aesthetic advantage of covering the staples render the fifth panel preferable. The fifth panel also serves to enhance the structural integrity of the end product.

It also will be appreciated that the width $W_3$ of third panel 54 and the width "t" of the material between hinge score lines 36, 38 may be varied to accommodate different thicknesses of documents. In this regard, in an 8½" by 11" portfolio size, the provision of three widths has been found to accommodate a wide range of document thicknesses. Further, it has been found that in those situations where the actual thickness of the report is significantly less than the width $W_3$ of panel 54, a filler strip (not shown) may be inserted to bring the thickness of material in pocket 60 to a point where it approximates width $W_3$. The filler strip may take the form of a single thickness of material, or it may have a multiple thickness provided by an "accordion" folded material.

As used herein, the term "fold line" is used in a generic sense to refer to any one of several structures known in the art for producing a line in sheet material along which a fold is made. Specific examples of fold lines are cut scores, score lines and perforation lines. As is well known in the art, a cut score is formed by a rule having a height that cuts only partially through the paper (e.g. 50% through the paper) to compress the material along the score line without removing material. A cut score preferentially encourages folding in the direction away from the cut. A score line is similar to a cut score, but is formed by making an indentation in the stock material that produces a bulge of material on one side of the stock, and an indentation formed by knives that cut holes in the stock material along the perforation line.

In one embodiment of the invention, blank 10 has been formed from item code CK 849 sheet material obtainable through Dillard Paper Company, P.O. Box 508, Morrisville, N.C. This material is further designated as Curtis Linen DT CV26x40 52N 130 lb. The dimensions of one preferred blank are as follows:

Front and rear cover portions: 9"×11 9/16"
Dimension "t" between hinge fold lines: ½"
Overall dimensions of document securement flap: 8½"×2½"
$W_1$, $W_2$: ¾"
$W_3$: 11/32"
$W_4$, $W_5$: 5/16"

In this embodiment, hinge fold lines 36, 38 are formed as score lines. First, third and fourth fold lines 40, 44 and 46 are cut scores with the "removed" material being at the back face of the blank to facilitate folding in the directions described above. Second and fifth fold lines 42 and 48 are perforation lines. This combination of cut scores and perforation lines at document securement flap 30 has proven to provide superior results.

The above cover portion dimensions may, of course, be varied to accommodate various paper sizes, for example, 8½"×14" paper and $A_4$ paper. The dimensions "t" and $W_3$ may be varied to accommodate different ranges of document thicknesses. $W_3$ dimensions in the range from 3/16" to ¾" will accommodate most reports of the type that are bound by a system as described herein.

While the present invention has been described in connection with certain illustrated embodiments, it will be appreciated that modifications can be made without departing from the true spirit and scope of the invention.

That which is claimed is:

1. A system for securely holding together the pages of a multiple-page document, and protecting the same, said system being characterized by the utilization of a blank of sheet material requiring no additional components other than securing or fastening means, said system comprising:

a blank of sheet material, said blank including a front cover portion, a rear cover portion and a central hinge portion permitting relative movement of the front cover portion over the rear cover portion for covering the document, said blank further including a document securement flap extending from an edge of one of the cover portions, said flap serving to define a first fold line at said edge and sequential second, third and fourth fold lines substantially parallel to the first fold line; the four fold lines, in turn, defining respective first, second, third and fourth panels sequentially extending from said one cover portion;

the third and fourth panels each being folded approximately 90° in the same direction about the third and fourth fold lines to form a pocket for receiving one marginal edge portion of the multiple-page document;

document securement means for securing the document in the pocket; and the first and second panels being folded about the second fold line to bring the back surfaces thereof into contact, and fastening means for fastening the back of the first panel to the back of the second panel;

whereby the document is secured in said pocket in such a fashion as to be pivotally connected to said one cover portion about said first fold line.

2. The system of claim 1 wherein said document securement means comprises staples extending through the fourth panel, the document and the second panel.

3. The system of claim 2 wherein said document securement flap includes a fifth panel joined to said fourth panel at a fifth fold line, and the fifth panel is folded 180° back upon the fourth panel and fastened thereto to hide the staples from view.

4. The system of claim 3 wherein the width ($W_5$) of the fifth panel is substantially equal to the width ($W_4$) of the fourth panel.

5. The system of claim 4 wherein the width ($W_1$) of the first panel is substantially equal to the width ($W_2$) of the second panel.

6. The system of claim 1 wherein the width ($W_3$) of the third panel that defines the height of said pocket is on the order of about 3/16" to about ¾".

7. The system of claim 1 wherein said blank is formed from linen-containing sheet material having a weight designation on the order of about 130 lb.

8. The system of claim 1 wherein activated transfer tape is utilized as the fastening means to fasten the back of the first panel to the back of the second panel.

9. The system of claim 1 wherein said first, third and fourth fold lines are cut scores.

10. The system of claim 9 wherein said second fold line is a perforation line.

11. A portfolio system for securely holding together the pages of a multiple-page document, and protecting the same, said system being characterized by the utilization of a blank of sheet material requiring no additional components other than securement or fastening means, said system comprising:

a blank of sheet material, said blank including a front cover portion, a rear cover portion and a central hinge portion permitting relative movement of the front cover portion over the rear cover portion for covering the document, said blank further including a document securement flap extending from the top edge of the rear cover portion, said flap serving to define a first fold line at said top edge and sequential second, third, fourth and fifth fold lines substantially parallel to the first fold line, the five fold lines, in turn, defining respective first, second, third, fourth and fifth panels sequentially extending from the rear cover portion;

the first, third and fourth fold lines being formed as cut scores and the second and fifth fold lines being formed as perforation lines;

the third and fourth panels each being folded approximately 90° in the same direction about the third and fourth fold lines to form a pocket for receiving one marginal edge portion of the document;

and staples securing the document in the pocket;

the first and second panels having approximately equal width dimensions ($W_1$, $W_2$) and being folded about the second fold line to bring the back surfaces thereof into contact, and fastening means for fastening the back of the first panel to the back of the second panel; and the fifth panel being folded 180° back upon the fourth panel and fastened thereto to hide the staples from view;

whereby the document is secured in said pocket in such a fashion as to be pivotally connected to the rear cover portion about said first fold line.

12. The portfolio system of claim 11 wherein said blank is formed from linen-containing sheet material having a weight designation on the order of 130 lb.

13. The portfolio system of claim 11 wherein the fastening of the first and second panels to each other and the fastening of the fourth panel to the fifth panel are achieved by activated transfer tape.

14. The portfolio system of claim 11 wherein said central hinge portion is formed by two parallel fold lines defining a hinge strip therebetween having a width dimension (t) that is roughly the same as the third document securement panel width ($W_3$).

15. A blank of relatively rigid sheet material useful, in association with securement or fastening means, to form a portfolio for securement and protection of a multiple-page document, said blank comprising:

a front cover portion;

a rear cover portion;

a central hinge portion permitting relative movement of the front cover portion over the rear cover portion for covering the document;

a document securement flap extending from the top edge of the rear cover portion, said flap serving to define a first fold line at said top edge and sequential second, third and fourth fold lines substantially parallel to the first fold line;

the four fold lines, in turn, defining respective first, second, third and fourth panels sequentially extending from the cover portion;

the third panel having a width ($W_3$) on the order of the thickness of the multiple-page document and being adapted to serve as the base portion of a document-receiving pocket formed in conjunction with the second and fourth panels;

the first, third and fourth fold lines being formed as cut scores; and the second fold line being formed as a perforation line.

16. The blank of claim 15 wherein said document securement flap includes a fifth panel joined to said fourth panel at a fifth fold line, said fifth fold line being formed as a perforation line.

17. The blank of claim 16 including first fastening means for fastening the back of the first panel to the back of the second panel and second fastening means for fastening the back of the fourth panel to the back of the fifth panel.

18. The blank of claim 17 wherein said first and second fastening means comprise transfer tape.

19. The blank of claim 15 wherein said central hinge is formed by two parallel fold lines defining a hinge strip therebetween having a width dimension (t) that is roughly the same as the third document securement panel width ($W_3$).

* * * * *